United States Patent [19]

Olyphant, Jr.

[11] Patent Number: 4,475,006

[45] Date of Patent: Oct. 2, 1984

[54] SHIELDED RIBBON CABLE

[75] Inventor: Murray Olyphant, Jr., Lake Elmo, Minn.

[73] Assignee: Minnesota Mining and Manufacturing Company, St. Paul, Minn.

[21] Appl. No.: 244,289

[22] Filed: Mar. 16, 1981

[51] Int. Cl.[3] ..... H01B 11/06

[52] U.S. Cl. ..... 174/36; 174/102 R; 174/117 F; 174/105 R

[58] Field of Search ..... 174/36, 102 R, 105 R, 174/117 F, 117 FF, 115, 117 R, 107; 339/99 R

[56] References Cited

U.S. PATENT DOCUMENTS

| | | | |
|---|---|---|---|
| 3,155,809 | 11/1964 | Griswold | 219/86 |
| 3,179,904 | 4/1965 | Paulsen | 174/36 X |
| 3,576,723 | 4/1971 | Angele | 174/117 F |
| 3,582,532 | 6/1971 | Plummer | 174/36 |
| 3,612,743 | 10/1971 | Angele | 174/36 |
| 3,612,744 | 10/1971 | Thomas | 174/36 |
| 3,634,782 | 1/1972 | Marshall | 174/117 F |
| 3,636,234 | 1/1972 | Wakefield | 174/36 |
| 3,662,090 | 5/1972 | Grey | 174/107 |
| 3,691,509 | 9/1972 | Krol | 339/14 R |
| 3,697,925 | 10/1972 | Henschen | 339/17 F |
| 3,700,825 | 10/1972 | Taplin et al. | 174/36 |
| 3,728,661 | 4/1973 | Kassabgi | 174/117 X |
| 3,735,022 | 5/1973 | Estep | 117/117 F |
| 3,757,029 | 9/1973 | Marshall | 174/36 |
| 3,763,306 | 10/1973 | Marshall | 174/115 |
| 3,768,067 | 10/1973 | Rault | 339/99 R |
| 3,818,117 | 6/1974 | Reyner et al. | 174/36 |
| 4,075,419 | 2/1978 | Virkus | 174/107 |
| 4,079,190 | 3/1978 | Jones et al. | 174/102 R |
| 4,209,215 | 6/1980 | Verma | 339/17 F |
| 4,287,385 | 9/1981 | Dombrowsky | 174/36 |

FOREIGN PATENT DOCUMENTS

| | | | |
|---|---|---|---|
| 2547152 | 4/1977 | Fed. Rep. of Germany . | |
| 2622297 | 12/1977 | Fed. Rep. of Germany | 174/36 |
| 2754342 | 6/1979 | Fed. Rep. of Germany | 174/36 |
| 2826688 | 1/1980 | Fed. Rep. of Germany | 174/36 |
| 2064071 | 9/1970 | France . | |
| 700459 | 12/1973 | United Kingdom . | |

OTHER PUBLICATIONS

IBM Technical Disclosure Bulletin, vol. 9, No. 3, Aug. 1966, pp. 245–246, J. G. Boles, et al., "Metalizing Flat Cable".

*Primary Examiner*—Volodymyr Y. Mayewsky
*Attorney, Agent, or Firm*—Donald M. Sell; William D. Bauer

[57] ABSTRACT

A fully shielded flexible ribbon cable having transmission line electrical characteristics and flexible ribbon cable mechanical characteristics capable of easy mass termination. The cable has a plurality of circular uniformly spaced signal conductors lying in a single plane encased in insulation having an effectively uniform dielectric constant of not more than 3.0. A sheet conductor is bonded to the insulation providing both transverse and longitudinal electrical continuity. The ratio of the diameter of the signal conductors to the distance between centers of the signal conductors is between 0.16 and 0.42. The ratio between the thickness of the cable at the inner surface of the sheet conductor to the distance between centers of the signal conductors is not more than 1.5.

13 Claims, 7 Drawing Figures

SHIELDED RIBBON CABLE

BACKGROUND OF THE INVENTION

The present invention relates generally to the field of shielded ribbon cables and more particularly to mass terminable shielded ribbon cables exhibiting desirable electrical characteristics.

There exists a need for an electrical signal transmission cable which has both desirable signal transmission line characteristics and desirable physical characteristics. In order to exhibit desirable signal transmission line characteristics, the particular cable must exhibit low distortion, low attenuation at high frequency, radiate little electro-magnetic interference, not be susceptible to electro-magnetic interference, and exhibit a low amount of crosstalk between signal conductors, forward and backward. Desirable physical characteristics in a cable are the use of a multiplicity of signal conductors, capability for easy mass termination, low cost, flexibility and compactness.

There exists in the market place a multiconductor, flexible, mass terminable ribbon cable such as the 3365 cable manufactured by Minnesota Mining and Manufacturing Company, St. Paul, Minn. and sold under the trademark Scotchflex. While this is a very useful product, there are a number of uses of ribbon cable where the electrical characteristics of this cable are not sufficient. Such applications may involve the connection of a digital computer to a remote peripheral unit, such as a disk storage unit, printer, keyboard, display or modem. In these situations, it may be desirable and necessary to utilize a cable which exhibits desirable signal transmission characteristics.

Some critical cable applications requiring signal transmission line characteristics have been met with coaxial cables. With coaxial cables individual signal conductors are encased in individual shields. While exhibiting desirable electrical signal transmission line characteristics, these cables, however, suffer the disadvantage of the lack of a multiplicity of conductors and the lack of easy mass termination as well as relatively high initial cost.

One type of prior art cable is a cable known as a ribbon coaxial cable. In a ribbon coaxial cable, a plurality of separate coaxial cables are packaged together to form a ribbon cable. Each individual signal conductor is wrapped with its own separate individual shield. An example of this type of cable is Underwriters Laboratory (UL) Style No. 2741 cable. While this type of cable does provide generally good transmission line electrical characteristics, it suffers from many disadvantages. A typical example of this product contains signal conductors on 100 mil (2.54 millimeters) centers as opposed to the more typical 50 mil (1.27 millimeters) centers with the previously mentioned ribbon cable. The ribbon coaxial cable is not as compact, of course, because of the necessity of wrapping each individual signal conductor with its individual shield. In addition to being relatively expensive to manufacture, the ribbon coaxial cable is bulky due to the spacing of the individual signal conductors and, in addition, is not easily mass terminable. Since each individual signal conductor carries its own shield, the termination process involves separately stripping and terminating each individual shield wire, hardly a mass termination operation. Further, the particular UL Style 2741 cable uses a helical wrap of a thin polyester film/aluminum foil laminate as its shield which does not necessarily provide good electrical continuity. In order to help correct this problem, the 2741 cable uses a drain wire run longitudinally along the cable with the shield to attempt to provide good longitudinal electrical continuity. However, since the drain wire is not connected to the shield but makes intermittent and variable contact with the shield, the electrical characteristics of the cable are not uniform along its length and tend to vary from signal conductor to signal conductor. These variable electrical characteristics results in a skewing of electrical pulses simultaneously applied to more than one signal conductor and to higher attenuation of the electrical pulses than occurs with a longitudinally continuous shield.

Historically, a shielded cable has meant any of a variety of cables which include a cable with a shield only on one side of the ribbon cable or even in some instances a shield on both sides of the ribbon cable but without shielding along the cable edges or without electrical continuity between the shield on each side. In order to eliminate electro-magnetic interference, both radiation and susceptibility, it is necessary to have a full 360 degree transverse shield around the ribbon cable. Thus, for purposes of this invention, a shielded cable means a cable which is fully shielded with a 360 degree circumferential transverse shield providing full electrically continuity, both transversely and longitudinally. A ribbon cable with a shield on one side only or a ribbon cable with a shield along both sides without shielded edges is not a true shielded cable and will not prevent electro-magnetic interference.

There are several examples of prior art ribbon cables which utilize conductive shielding on only one side. These cables suffer adverse electrical characteristics with increased signal attenuation over a comparable cable without shield and an increased rise time degradation. Further, the one side shield will not provide full shielding against electro-magnetic interference. U.S. Pat. No. 4,209,215, Verma, Mass Terminable Shielded Flat Flexible Cable and Method of Making Such Cables, provides a typical ribbon cable with a one-side shield. This cable, however, does not provide desirable electro-magnetic interference protection. U.S. Pat. Nos. 3,576,723, Angele et al, Method of Making Shielded Flat Cable, and U.S. Pat. No. 3,612,743, Angele et al, Shielded Flat Cable, provide a ribbon cable coated with a shielding material on one side. Again, this cable suffers disadvantages because it is only a single-sided shield. U.S. Pat. No. 3,818,117, Reyner II, Low Attenuation Flat Flexible Cable, is another typical single-sided shield cable. However, the Reyner cable is not even a good single-sided shielded cable because the conductive ground plane contains slots which are used to control the impedance and cable attenuation characteristics.

Some prior art cables utilize a double side shield but without full 360 degree shielding. U.S. Pat. No. 3,757,029, Marshall, Shielded Flat Cable, is a typical example of a ribbon cable with a double side shield. However, notice that in Marshall, the shield is not a full 360 degree transverse shield as the sides of the ribbon cable are open and are not shielded. Further, the conductive metallic strips used to provide the shield on both sides do not provide electrical continuity with each other. This cable suffers from inadequate protection from electro-magnetic interference and from a non-uniform characteristic impedance because of the lack of bonding of the shield to the cable dielectric, and also has electrical characteristics which are not suitable for fast rise time transmission line cable. U.S. Pat. No. 3,700,825, Taplin et al, Circuit Interconnecting Cables and Methods of Making Such Cables, is another example of a cable with a double side shield. An open lattice structure is used on both sides of the cable. However, the lattice structures on opposite sides are not interconnected and this cable does not provide a full 360 degree shield. U.S. Pat. No. 3,612,744, Thomas, Flexible Flat Conductor Cable of Variable Electrical Characteristics, also shows a cabe with a double sided shield. Perforated foil is utilized with a longitudinal drain wire on each side along with several separate distinctive dielectric layers. Again the ground planes provided by the perforated foil and the drain lines are not interconnected and do not provide a full 360 degree shield. All of these cables suffer from inadequate protection from electromagnetic interference.

Some prior art cables have utilized a full 360 degree transverse shield but suffer in their electrical characteristics. U.S. Pat. No. 3,634,782, Marshall, Coaxial Flat Cable, provides a ribbon cable which has a 360 degree transverse shielded braid. While this cable does have a full shield against electro-magnetic interference, it suffers from other disadvantages. The shielded braid is not necessarily bonded to the cable dielectric. This lack of bonding will provide a non-uniform dielectric constant, both transversely and longitudinally from conductor to shield. This will result in excessive forward crosstalk and will result in non-uniform characteristic impedance. Another cable having a full 360 degree shield a vinyl insulated ribbon cable with a vinyl jacket covering the loose electro-magnetic shield such as the 3517 cable manufactured by Minnesota Mining and Manufacturing Company, St. Paul, Minn. and sold under the trademark Scotchflex®. While this cable provides for adequate protection against electro-magnetic interference, the use of the vinyl insulation and the lack of bonding of the shield to the insulation and lack of other geometric considerations provide electrical characteristics which are not suitable for high speed data transmission line applications. Another example of a ribbon cable attempting to be both shielded and have desirable electrical characteristics is a cable which is manufactured by Spectrastrip, 7100 Lampson Avenue, Garden Grove, Calif. The cable construction is a standard 60 conductor, 28 American Wire Gauge stranded copper with gray vinyl insulation in a double hump profile with the cable 36 mils (0.91 millimeters) thick at the humps. A shield is provided on both sides using two layers of an aluminum foil and polyester film construction similar to the Sun Chemical 1001 film with the foil sides of both layers facing the same direction so that they overlap at the edge and provide electrical continuity. A heavy black vinyl jacket is extruded over the shield. On one side of the cable the jacket forces the shield layer which has the polyester side toward the signal conductors to conform to and adhere to the vinyl. On the opposite side of the cable the polyester side of the shield layer bonds to the jacket leaving a variable air gap between the aluminum and the insulation containing the conductors. This cable shows a variable characteristic impedance and an excessive voltage attenuation, along with excessive rise time degradation. U.S. Pat. No. 3,582,532, Plummer, Shielded Jacket Assembly for Flat Cables, shows a zipper jacketed shielded cable. The shield is attached to the interior of the jacket. The variable spacing between the shield and the insulation results in a variable charactistic impedance and unpredictable crosstalk.

Some prior art cables have utilized a plurality of layers of differing dielectrics to reduce forward crosstalk. U.S. Pat. No. 3,763,306, Marshall, Flat Multi-Signal Transmission Line Cable With Plural Insulation, provides a ribbon cable with this construction. This cable is a ribbon cable with a multiplicity of signal conductors but with two distinctly different dielectrics around the signal conductors. The cable has a jacket encasing a standard insulation with a material of a higher dielectric constant than the standard dielectric. This cable is not shielded and also suffers the disadvantage of exhibiting excessive backward crosstalk. U.S. Pat. No. 3,735,022, Estep, Interference Controlled Communications Cable, also illustrates an attempt to control crosstalk by providing a cable with dual differing dielectric materials.

These prior art cables demonstrate that many attempts have been made to achieve a shielded, mass terminable, multiple conductor, flexible ribbon cable having electrical characteristics suitable for transmission line characteristics. These prior art cables also demonstrate that the prior attempts at a total solution to this problem have failed. These prior art cables demonstrate the complexity of cable construction having suitable transmission line electrical characteristics and demonstrate that it is not possible to simply wrap a metal shield around an existing flexible ribbon cable and achieve suitable electrical transmission line characteristics. The problem is complex, and the results achieved depend upon many interrelated physical characteristics.

SUMMARY OF THE INVENTION

A flexible ribbon cable is provided which has a signal portion containing a plurality of substantially longitudinally parallel circular conductors having a uniform diameter and lying in a single plane. The plurality of conductors have a transversely and longitudinally uniform predetermined cross-sectional spacing. Insulation encases the plurality of conductors with the insulation having an effectively uniform dielectric constant of not more than 3.0. The insulation has two outer surfaces substantially parallel to the single plane of the parallel circular conductors. A sheet conductor, having two inner surfaces conforming to the two outer surfaces of the insulation, is bonded to the insulation on the two outer surfaces. The sheet conductor encases the insulation on substantially all cross-sectional sides and provides both circumferential transverse and longitudinal electrical continuity. The ratio of the value of the diameter of the parallel circular conductors to the value of the distance between the centers of the parallel circular conductors is between 0.16 and 0.42 inclusive. Further, the ratio between the value of the distance between the two inner surfaces of the sheet conductor to the value of the distance between centers of the parallel circular conductors cannot be more than 1.5. Constructed in this manner, the signal portion of the flexible ribbon cable possesses electrical characteristics approximating the electrical characteristics of a coaxial cable with comparable insulation thickness.

In a preferred embodiment, an adhesive intimately bonds the two inner surfaces of the sheet conductor to the two outer surfaces of the insulation. In another preferred embodiment, the sheet conductor is strippable from the insulation so that removal of the sheet conductor may be effected where desirable in order to mass terminate the ribbon cable.

In a further preferred embodiment, the insulation may have at least one outer surface which is ridged longitudinally with the ridges corresponding to the plurality of circular conductors. In this preferred embodiment the ridged surface provides an efficient means of locating the cable transversely in a mass termination device or connector.

In another preferred embodiment, the flexible ribbon cable may be constructed with the insulation made of separate layers of dielectric material lying just above and just below the single plane of the signal conductors intimately bonded together along the single plane and to the plurality of circular conductors with a low loss adhesive. In a preferred embodiment, the low loss adhesive is a block copolymer elastomer stabilized with antioxidants.

The flexible ribbon cable of the present invention provides the desirable electrical characteristics of small diameter coaxial cable of comparable insulation (dielectric) thickness with the desirable physical characteristics of present day non-shielded ribbon cable.

The significant advantages of the cable of the present invention are surprising in that a cable is constructed where all of the conductors can be utilized as signal conductors which can easily be positioned on the commonly desirable 50 mil (1.27 millimeters) centers without intermediate grounds and which cable does not exhibit unacceptable crosstalk, either forward, or backward and which cable has a very low attenuation and rise time degradation of fast rise time pulses while at the same time providing full electro-magnetic interference shielding. The cable of the present invention even outperforms small diameter coaxial cable of comparable dielectric thickness. Such coaxial cable in the ribbon construction typically has signal conductors on 100 mil (2.54 millimeters) centers since allowance must be made for the space required by the individual shield wrapped around each signal conductor. Further, when that coaxial cable is driven differentially an additional all-encompassing shield must further be provided around the entire cable to provide for proper electro-magnetic interference protection. With the cable driven differentially, the potentials present on the signal conductor and its individual shield will be equal and opposite, thus the potential on each individual shield conductor, if not further shielded, would radiate and be susceptible to electro-magnetic interference.

Thus, the cable of the present invention provides for many significant advantages. The cable is flexible, being able to bend and flex in order to conform as desired. The cable has a uniform characteristic impedance, both transversely from signal conductor to signal conductor and longitudinally over the length of the cable. The uniform characteristic impedance is provided primarily from the uniform dielectric constant of the insulation, both transversely and longitudinally, and by the bonding of the sheet conductor, i.e. the shield, to the insulation. The bonded shield results in the intimate contact of the insulation to the shield and prevents gapping between the shield and the insulation which would introduce air into the cross-sectional dielectric. A variable amount of gap and hence a variable amount of air and a varying distance between the two inner surfaces of the sheet conductor would provide, both transversely and longitudinally over the length of the cable, a varying effective dielectric constant and hence a variable characteristic impedance and excessive forward and backward crosstalk. The cable of the present invention also provides for low signal attenuation. The low signal attenuation is primarily provided by the use of insulation with a maximum dielectric constant of 3.0 and a low dielectric loss by limiting the minimum conductor size with respect to the geometry of the cable which can be expressed generally by the requirement that the ratio of the value of the diameter of the circular conductors to the value of the distance between centers of the circular conductors not less than 0.16 and further is provided by a minimum conductivity (maximum resistivity) of the shield. The shield generally should have a resistivity of less than 3.5 milliohms per square and preferably having a resistivity of less than 1 milliohm per square.

The cable of the present invention also provides for easy mass terminability. It is not necessary to separately strip an individual shield or drain wire for each signal conductor, since the single sheet conductor provides a common shield for all signal conductors. Further providing for mass terminability is the uniform spacing of the signal conductors and the easy strippability of the shield from the cable insulation. The cable of the present invention also provides for a low forward crosstalk between signal conductors. Contributing to the low forward crosstalk is the effectively uniform transverse and longitudinal dielectric constant of the insulation. A primary feature contributing to this uniform dielectric constant is the bonding of the sheet conductor shield to the cable insulation which provides an intimate contact between the sheet conductor and the insulation which will prevent air gaps from forming.

The cable of the present invention also provides for a low backward crosstalk between signal conductors. A primary contribution to the low backward crosstalk is the cross-sectional geometry of the cable. Two geometric constraints are important. The first is the ratio of the value, d, of the diameter of the parallel circular conductors to the value, c, of the distance between the centers of the parallel circular conductors which should be not less than 0.16 and not more than 0.42. The other geometric constraint is the ratio of the value, b, of the spacing between the two inner surfaces of the sheet conductor to the value, d, of the distance between the centers of the parallel circular conductors. This ratio should not be more than 1.5. Preferably, the geometric constraints of the cable of the present invention could be represented by the formula:

$$b \leqq \frac{1.94\,c}{(3.01)^{d/c}}$$

which will provide for a backward crosstalk of not more than 7.5%. Still more preferably, the geometric constraints of the cable of the present invention can be stated by the formula:

$$b \leqq \frac{1.60\,c}{(2.82)^{d/c}}$$

which will provide a backward crosstalk of not more than 5%.

If the cable of the present invention is constructed in a sandwich fashion with separate sheets of dielectric material lying just above and just below the single plane of the signal conductors bonded together and to the circular conductors, it is necessary to use an adhesive which intimately and permanently bonds the dielectric together and maintains an intimate bonding of the dielectric to the signal conductors, and it is also necessary that the adhesive be a low loss adhesive. Such a low loss adhesive is a block copolymer elastomer stabilized with anti-oxidants.

It can be seen that the proper selection of the myriad of physical properties of the cable of the present invention combine to provide the surprising result of a transmission line cable having coaxial type electrical characteristics without individual coaxial signal conductors and individual shields.

BRIEF DESCRIPTION OF THE DRAWINGS

The foregoing advantages, construction and operation of the present invention will become more readily apparent from the following description and accompanying drawings in which.

Detailed Description of the Preferred Embodiments

Figure 1:
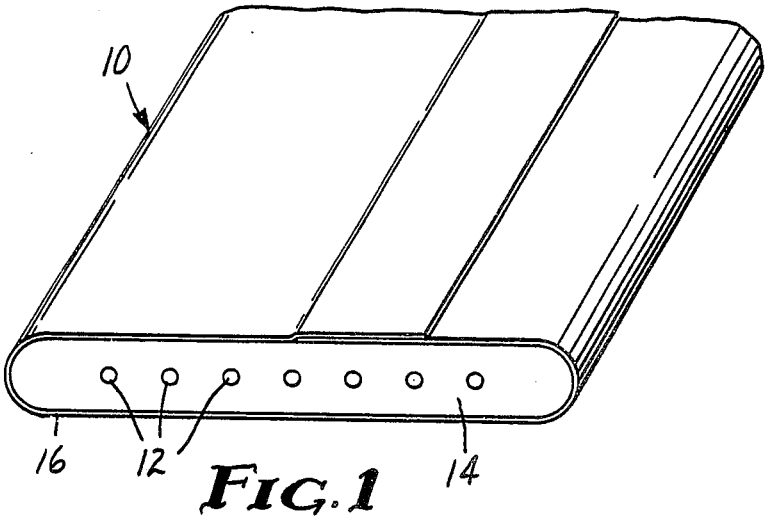
FIG. 1 is a perspective view of the cable.

FIG. 1 shows the cable 10 having a plurality of signal conductors 12 encased in an insulation 14 and covered with a sheet conductor 16. It is contemplated that all of the signal conductors 12 may be utilized to carry signals in a signal-signal-signal—configuration. In this most efficient configuration, each signal conductor 12 carries its own signal and employs the sheet conductor 16 as a common ground return in an unbalanced drive situation. The cable 10 can also be utilized in balanced drive when the signal conductors 12 are driven in pairs. Even when each signal conductor 12 is utilized to carry an individual signal, a cable 10 constructed according to the present invention will provide, for each signal conductor, the practical equivalent electrical characteristics of a coaxial cable with an individual shield and much more compactly and easily terminated. The signal conductors 12 are all generally circular and are uniformly spaced in a single plane. The insulation 14 has an effectively uniform dielectric constant of not more than 3.0. The two major outer surfaces of the insulation 14 form substantially planar surfaces parallel to the plane containing the signal conductors 12. The sheet conductor 16 has two inner surfaces conforming to the two outer surfaces of the insulation 14 and is bonded to the insulation 14 to provide intimate contact between the sheet conductor 16 and the insulation 14. The sheet conductor 16 provides electrical continuity, both transversely and longitudinally. In FIG. 1, the sheet conductor is illustrated as being cigarette-wrapped along the length of the cable 10 which provides good electrical continuity with an overlap at the seam of the cigarette wrap. An alternative configuration for the sheet conductor 16 is a separate shield layer on each major surface of the cable with the two shield layers overlapping and contacting at the edges providing both transverse and longitudinal electrical continuity.

Figure 2:
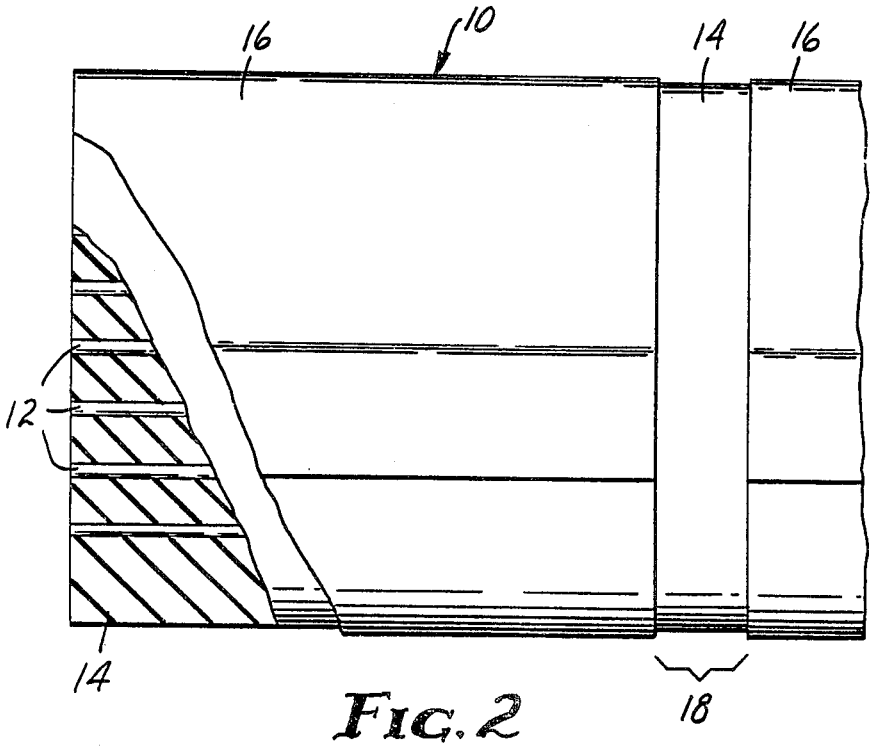
FIG. 2 is a top view of the signal portion of the cable.

FIG. 2 shows a top view of the cable 10 again showing the signal conductors 12 in partial cutaway view illustrating again that the signal conductors are uniformly spaced, both transversely and longitudinally along the cable. The sheet conductor 16 again is shown intimately bonded to the insulation 14. A termination area 18 is also illustrated showing the sheet conductor 16 stripped from the insulation 14 at a location at which a mass termination connector may be installed. With the sheet conductor 16 providing the shield for the cable 10, it is very easy to strip a portion of the sheet conductor 16 from the insulation 14, at for example termination area 18, to provide for the installation of a mass terminable connector. An example of a mass terminable connector which could be utilized with the cable 10 is the 3400 Series connector, and in particular 3425 connector, a 50 conductor version, manufactured by Minnesota Mining and Manufacturing Company of Saint Paul, Minn. and sold under the trademark Scotchflex.

Figure 3:
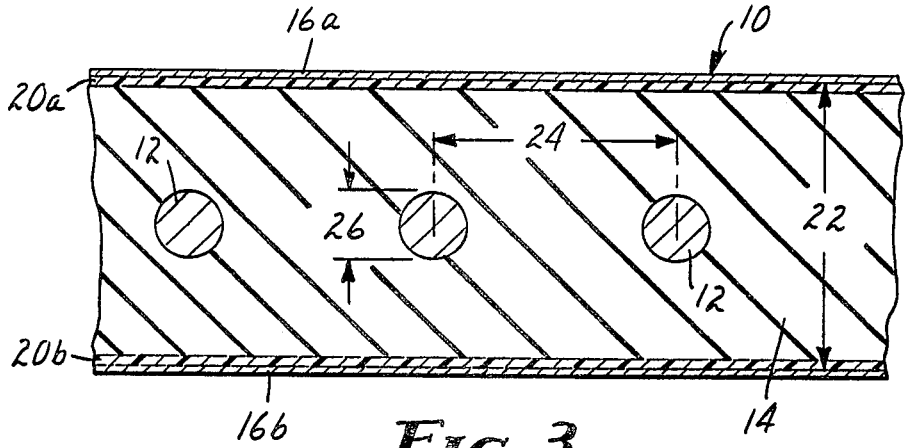
FIG. 3 is a cross-sectional view of the cable showing the preferred geometry.

FIG. 3 shows a cross-section of the cable 10 again showing the signal conductors 12 encased in insulation 14 and covered by sheet conductor 16A and 16B. The signal conductors 12 are all of circular cross-section and have a uniform cross-sectional spacing. The sheet conductor 16A and 16B is bonded to the insulation 14 providing an intimate contact. This bonding may occur by a direct application of heat and pressure creating a direct bond which is easily strippable yet reliable. The bonding could also be provided by a separate adhesive 20A and 20B. Adhesive layer 20A bonds shield layer 16A to insulation 14 and adhesive layer 20B bonds shield layer 16B to insulation 14. The cable 10 has a distance 22 of a value, b, between the two inner surfaces of the sheet conductor 16A and 16B. This thickness value, b, is substantially the thickness between the two major outer surfaces of insulation 14 but also includes the thickness of adhesive layers 20A and 20B. The cable 10 also has a distance 24 between the centers of adjacent signal conductors 12 of a value c. Further, the cable 10 has a diameter 26 of each signal conductor 12 of a value d.

The signal conductors 12 in FIG. 3 are all of circular cross section and are equally spaced. The signal conductors 12 may be either solid or stranded wire constructed of a good conductor such as copper or aluminum. It is generally preferred that the value, d, of the diameter 26 of the signal conductors 12 be from 32 AWG (American Wire Guage) to 26 AWG (from 100 to 278 circular mils).

The insulation 14 of the cable 10 must have an effectively uniform dielectric constant of not more than 3.0. Materials which may be utilized for the insulation 14 will almost certainly have a dielectric constant of at least 1.0 and generally will have a dielectric constant of at least 1.1. In a preferred embodiment, the insulation 14 is a polymer and still preferably will have a low dielectric loss. Examples of preferred materials for insulation 14 are low-loss plastics and elastomers which include polyethylene, polypropylene, polyurethane, tetrafluoroethylene such as TFE Polymeric Dielectric sold under the trademark Teflon, fluorinated ethylene propylene such as FEP Polymeric Dielectric sold under the trademark Teflon, and EPDM rubber. In a preferred embodiment insulation 14 is constructed from a polyethylene or from a urethane foam. The insulation 14 encases the signal conductors 12 and has two major surfaces generally coplanar with the plane of the signal conductors 12 and the planes of the shield layers 16A and 16B. It is generally preferred that the insulation 14 and adhesive layers 20A and 20B have a thickness 22, b, of up to 75 mils (1.9 milli meters). Greater thicknesses 22 could be utilized and would provide, with other proper geometric constraints, proper electrical characteristics. Presently available mass termination connectors generally are restricted to a spacing of not more than 75 mils (1.9 millimeters). With a foam type material for insulation 14, which is then somewhat compressible, somewhat greater than 75 mils (1.9 millimeters) thicknesses 22 could also preferably be utilized. It is preferred that the insulation 14 have a dielectric loss tangent of not more than 0.005 in the range of one megahertz to one gigahertz. Further, it is preferred that the dielectric loss tangent of the insulation 14 be not more than 0.002 in the range of one megahertz to one gigahertz. In addition, the polymer utilized for the insulation 14 may have additional ingredients without departing from the material contemplated by the present invention. The insulation 14 may be a polymer which may also have certain crosslinking agents, antioxidants, modifiers, and inert fillers which will not detract generally from their usefulness as insulation 14.

The sheet conductor 16A and 16B operates to provide a shield for the cable 10 to prevent both radiation and susceptibility to electro-magnetic interference. Sheet conductor 16A and 16B has two major inner surfaces which conform to the two major outer surfaces of insulation 14. Shield layers 16A and 16B provide electrical continuity both transversely and longitudinally along the cable 10. Although not specifically illustrated in FIG. 3, it is contemplated that electrical continuity will be maintained between shield layer 16A and shield layer 16B at both edges of the cable 10. Although the sheet conductor is illustrated in FIG. 3 as separate shield layers 16A and 16B, it is contemplated, and in fact preferred, that both shield layers 16A and 16B be a single sheet conductor 16 wrapped around the cable 10 with a single overlap to provide adequate electrical continuity. It is preferred that the sheet conductor 16A and 16B have a maximum resistivity (minimum conductivity) of 3.5 milliohms per square and still preferably of one milliohm per square. The material utilized for sheet conductor 16A and 16B could be a one ounce (1.4 mil, 0.036 millimeters) rolled copper foil, an aluminum foil/-polyester laminate or an expanded copper foil mesh. An example of an aluminum foil/polyester laminate is 0.35 mils (0.009 millimeters) of aluminum and 0.5 mils (0.013 millimeters of polyester film such as 1001 laminate manufactured by the Facile Division of Sun Chemical Company, 185 Sixth Avenue, Patterson, N.J. and sold under the trademark "Lamiglas". The sheet conductor 16A and 16B cigarette wrapped as illustrated in FIG. 1 must be overlapped with the foil surfaces in contact to provide good electrical continuity both transversely and longitudinally.

Sheet conductor 16A and 16B is bonded to insulation 14. It is preferred that the bonding between the sheet conductor 16A and 16B and the insulation 14 be done directly through the application of heat and pressure by passing the insulation 14 and the sheet conductor 16A and 16B through hot rollers.

It is necessary to provide an intimate contact between the sheet conductor 16A and 16B and the insulation 14. This intimate contact between the shield and the dielectric will provide for an effectively uniform transverse and longitudinal dielectric constant. This is necessary to prevent the formation of air gaps between the sheet conductor 16A and 16B and the insulation 14 particularly when the cable 10 is flexed. The intimate contact will provide for a constant characteristic impedance and a constant propagation speed. It also eliminates dielectric discontinuities which cause forward crosstalk and it prevents uncontrolled increases in the spacing between the inner surfaces of the sheet conductor 16A and 16B which can cause excessive backward crosstalk.

In addition to the direct bonding of the sheet conductor 16A and 16B to the insulation 14, an adhesive could also be utilized. This is illustrated in FIG. 3 by the adhesive layer 20A bonding shield layer 16A to insulation 14 and adhesive layer 20B bonding shield layer 16B to insulation 14. This adhesive could be a thin layer (less than 1.5 mils, 0.038 millimeters) of a conventional acrylate adhesive and in particular it has been found that low density polyethylene adhesive will provide the necessary bond and in addition allow for easy strippability of the sheet conductor 16A and 16B from the insulation 14 in order to easily mass terminate the cable 10.

It has been found that the cross sectional geometry of the cable 10 seriously affects the backward crosstalk characteristics between the signal conductors 12. While backward crosstalk of coaxial cable approaches zero, it is generally accepted that certain maximum values of backward crosstalk can be tolerated for most applications. It has been found that a generally acceptable cable 10 can be constructed by maintaining the proper ratios among the thickness 22 of a value b between the inner surfaces of the sheet conductor 16A and 16B the distance 24 of a value c between the centers of the signal conductors and the diameter 26 of a value d of the signal conductors 12. It has been found that the ratio of d divided by c must not be more than 0.42 in order to limit the backward crosstalk to an acceptable value and must not be less than 0.16 in order to provide for an acceptable attenuation. Further, it has been found that the ratio of b/c cannot be more than 1.5 in order to limit the backward crosstalk. Using these criteria, the backward crosstalk can generally be held below the 5 to 7.5% range.

With commonplace mass termination connecting equipment, it is relatively easy to terminate ribbon cable with a thickness 22 of up to about 55 mils. When a foam insulation is utilized, this dimension can be increased to 75 mils (1.9 millimeters) due to the compressibility of the foam. Using these criteria, a quite satisfactory cable 10 can be constructed with a thickness 22, b, of not more than 75 mils (1.9 millimeters) with a ratio of d/c of not more than 0.42.

Backward crosstalk can be controlled with even greater accuracy. For certain applications, a 7.5% backward crosstalk is acceptable. A preferred cable, then, is a cable constructed where $$b \leq \frac{1.94\,c}{(3.01)^{d/c}}$$

A cable constructed according to this formula will limit the backward crosstalk to not more than 7.5%. More demanding applications and most all of present day applications can tolerate a backward crosstalk of not more than 5%. A cable can be constructed to meet this requirement by utilizing the geometric constraint of $$b \leqq \frac{1.60\,c}{(2.82)^{d/c}}$$

Commonplace mass termination equipment for ribbon cables commonly have the distance 24 between centers of the signal conductors 12, c, to be approximately 50 mils (1.27 millimeters). While other prior art cables require the use of alternate or even every third conductor for signal carrying, the cable 10 of the present invention has satisfactory electrical characteristics utilizing every conductor as a signal wire. Therefore, a cable 10 constructed according to the present invention can have a signal wire every 50 mils (1.27 millimeters), or preferably in the range of 45–65 mils (1.14–1.65 millimeters) allowing for a dimensional tolerance. With a cable 10 constructed with a c equal to 50 mils (1.27 millimeters), a thickness 22, b, can be accommodated in the range of from 30 to 75 mils (0.76 to 1.9 millimeters). In order to prevent excessive signal attenuation, and to provide for termination with commonplace mass termination equipment, it is generally preferred that the diameter 32 of the signal conductors 12, d, be in the range from 26 AWG, American Wire Guage, to 32 AWG.

The geometric constraints of the present invention provide significant advantages over even the multi-coax ribbon cables. Where coaxial cable is utilized with a separate individual shield around each signal wire, the spacing of the signal wires generally becomes much greater than a typical 50 mil (1.27 millimeters) center signal conductor spacing in ribbon cables. Generally in the ribbon coaxial cables, signal wires are on 100 mil (2.54 millimeters) centers due to the necessity of including the separate individual shield for each signal conductor. Thus, it is apparent that the cable of the present invention provides a more compact cable than multi-coaxial ribbon cable. Further, for those requirements where the signal wire and the individual shield are driven differentially, the individual shield conductor then will still radiate electro-magnetic interference and an equivalent of a non-shielded cable will result. If it is necessary that such a differentially driven coaxial cable be shielded, then an additional all encompassing shield must then be provided in addition to the individual coaxial cable shields. While the cable of the present invention carries signals in a signal-signal-signal relationship, and with the typical spacing of 50 mil (1.27 millimeters) centers and further, with the electrical characteristics of the cable of the present invention acceptable to be used in place of coaxial cables, and still further, with the ease of the mass terminability of the cable of the present invention, it can be seen that a cable constructed according to the present invention is a truly advantageous cable.

Figure 4:
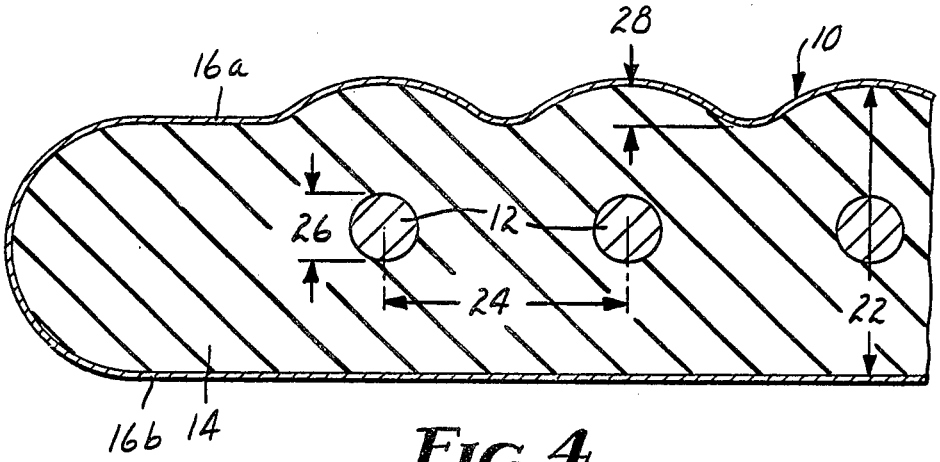
FIG. 4 is a cross-sectional view of the cable showing a ridged construction.

FIG. 4 illustrates another cross-sectional view of the cable 10 of the present invention showing a ridged construction on one surface of the insulation 14. Again, signal conductors 12 are encased in insulation 14 which is again bonded to sheet conductor 16A and 16B. Again, the key dimensions of cable 10 are the distance between inner surfaces of the sheet conductor 16A and 16B of a thickness 22, a distance 24 between centers of the signal conductors 12 and diameter 26 of the signal conductors 12. Note that in the embodiment illustrated in FIG. 4, the sheet conductor 16A and 16B is bonded directly to insulation 14 without the use of separate adhesive layers (20A and 20B in FIG. 3). In this embodiment, the distance between the inner surfaces of the sheet conductor 16A and 16B equals the thickness of the insulation 14. However in FIG. 4, one side of the cable 10, namely the side defined by shield layer 16A, is longitudinally ridged. Such ridges may be advantageous by providing ease in locating the mass termination equipment transversely with respect to the cable. Each individual signal conductor 12 can be easily located for the mass termination equipment rather than requiring an edge location determination as would be required without ridges. The distance 24 and the diameter 26 are defined exactly as in FIG. 3. The thickness 22 in FIG. 4 is defined as the thickness at the center of one of the signal conductors 12, or in this instance, the maximum thickness. Note that although the upper surface of the insulation 14, namely surface contacting shield layer 16A, is ridged, the top surface still generally conforms to a plane parallel to the plane defined by the centers of the signal conductors 12. It is within the scope of the present invention that "substantially in the same plane" referring to a surface of the insulation 14, contemplates the ridged construction on one or both surfaces. The depth 28 of the individual ridges is selectable, but is generally preferred to be in the range of from 5 to 10 mils (0.127 to 0.254 millimeters). It is preferable that the shield layer 16A conform intimately to the insulation 14 in order to provide an effective transverse dielectric constant. However, it has been found that some degree of non-conformance to the bottom of the ridges, or at the position between signal conductors 12, can be tolerated with acceptable electrical characteristics. It is critical that the shield layer 16A still be bonded to the insulation 14 to insure the intimate contact between the shield layer 16A and the insulation 14 in order to provide the effectively uniform transverse and longitudinal dielectric constant of the insulation 14.

Figure 5:
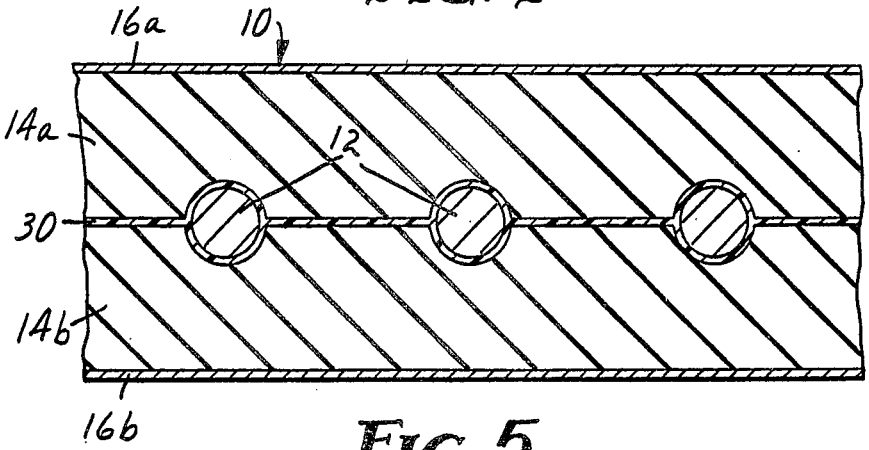
FIG. 5 is a cross-sectional view of the cable showing a sandwich construction.

FIG. 5 illustrates a cross-sectional view of a cable 10 showing a sandwich construction. Again, the signal conductors 12 are shown in spaced relationship in a single plane and are encased in insulation 14. However, in FIG. 5, the insulation 14 is composed of separate sheets 14A and 14B. In FIG. 5, sheet conductor 16A and 16B are bonded to insulation 14A and 14B, respectively. The sandwich construction of FIG. 5 is an alternative preferred embodiment illustrating that the insulation 14 may be composed of separate layers 14A and 14B and need not necessarily be formed from one homogenous piece. The sandwich construction of FIG. 5 may be easier to produce in some instances. The sandwich construction has been found most useful with a foam insulation 14, preferably polyurethane foam or polyethylene foam. The use of separate layers of insulation 14A and 14B requires a low loss adhesive 30. It is necessary that adhesive 30 intimately and permanently bond the insulation layers 14A and 14B to each other and to also bond the layers of insulation 14A and 14B to the signal conductors 12. Air gaps in this bonding will result in a non-uniform dielectric constant and to deterioration in the electrical characteristics of the cable 10. A suitable low loss adhesive 30 has been found to be the R-10 rubber adhesive family manufactured by a block copolymer elastomer stabilized with anti-oxidants such as Minnesota Mining and Manufacturing Company of Saint Paul, Minn. It is a pressure-sensitive adhesive which features high temperature performance, high sheer holding power, and a high adhesion to a wide variety of surfaces including itself and low surface energy plastics such as polyethylene and polypropylene.

The low loss adhesive 30 can have a higher loss tangent than the insulation 14 because the adhesive 30 is such a small part of the total thickness 22. However, the low loss adhesive 30 should not exhibit a loss tangent in excess of 0.05 in the range of from 1 to 100 megahertz. In a preferred embodiment, the low loss adhesive 30 has a loss tangent of below 0.01 in the range from 1 to 100 megahertz. Generally, adhesives which are generally satisfactory for the low loss adhesive 30 include the block copolymer types disclosed in U.S. Pat. No. 3,239,478, Harlan. An example of a particular adhesive which may be utilized for the low loss adhesive 30 which has been found to exhibit suitable properties can be constructed by combining the following ingredients:

| Ingredient | Name | Parts by Weight |
|---|---|---|
| ABA block polymer | Kraton 1101, Shell Chemical Company | 40 |
| AB block polymer | Solprene 1205, Phillips Petroleum Company | 60 |
| Tackifier | Alpha 135, Hercules Chemical Company | 150 |
| Extender oil | 371 N oil | 10 |
| Anti-oxidant | (1,3,5,trimethyl,-2,4,6,tris ditertbutyl-4-hydroxybenzyl)-benzene | 2 |
| Solvent | Toluene | 205.8 |

This adhesive is coated and dried on the internal surfaces of both layers of the insulation 14A and 14B to provide a dried adhesive thickness of about 0.001 inch (0.0254 millimeters).

A preferred sandwich construction of FIG. 5 utilizes a foam-type material for the insulation 14A and 14B. In particular, the Y-4042 double coated polyurethane foam tape manufactured under the Scotch tradename by Minnesota Mining and Manufacturing Company, of Saint Paul, Minn. is a preferred foam. The Y-4042 double coated urethane foam tape is a 1/32 inch (0.8 millimeters) thickness polyurethane foam coated on both sides with the R-10 rubber adhesive family. It is required that whatever foam is utilized for insulation 14A and 14B, the foam layers must be firmly bonded to each other and to the signal conductors 12. The use of a foam for the insulation layers 14A and 14B provides a degree of flexibility in the thickness 22 which will still allow mass termination in commonplace mass termination equipment and furthermore will allow more flexing of the sheet conductor 16A and 16B without cracking.

Figure 6:
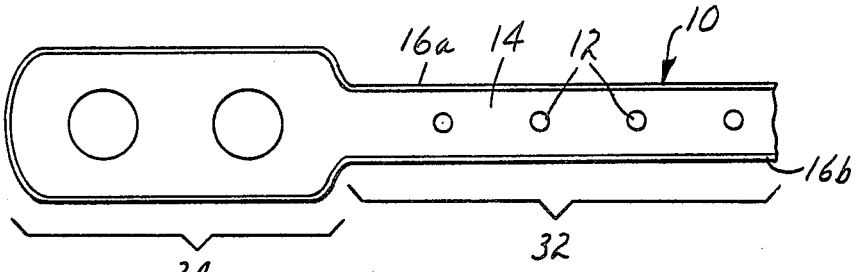
FIG. 6 is a cross-sectional view of the cable showing both a signal portion and a non-signal portion.

FIG. 6 illustrates that a cable 10 may be constructed of a signal portion 32 and a non-signal portion 34. It is recognized that while it is desirable that a cross-sectional portion of the cable 10 have the electrical characteristics described, it may also be desirable to include other conductors which would not necessarily have the same desirable electrical characteristics. An example of other signal requirements would be the inclusion of power conductors in an otherwise signal transmission line cable. FIG. 6 illustrates that it is within the scope of the present invention that the physical characteristic constraints of the present invention apply to the signal portion 32 and does not prohibit the use of other conductors in the cable which do not have these same constraints nor same desirable electrical characteristics.

Figure 7:
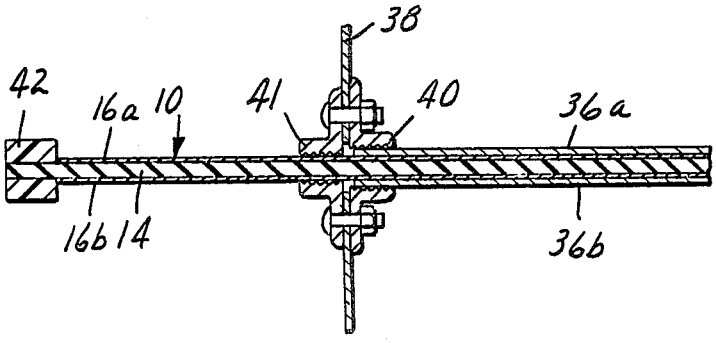
FIG. 7 illustrates a typical termination of the cable of the present invention.

FIG. 7 illustrates a longitudinal cross-sectional view of the cable 10. The cable 10 is shown having the insulation 14 bonded to a shield layer 16A and a shield layer 16B on its top and bottom surfaces. For ease of illustration, the signal conductors 12 are not illustrated. Also shown in FIG. 7 is a jacket 36A and 36B which may be used to cover the cable 10 to protect it from the elements and to meet requirements of the Underwriters Laboratory for external cable. A typical equipment termination of the cable 10 is illustrated. An equipment housing 38 is shown with the cable 10 entering the equipment through a hole or slot. The jacket 36 terminates just outside the housing 38 where an external clamp 40 secures the cable 10 mechanically to the housing 38 providing strain relief. An internal clamp 41 secures the cable 10 electrically to the housing 38 by contacting the now exposed sheet conductor 16A and 16B. The cable 10 then continues inside of the equipment without jacket 36 to the location for mass termination where a connector 42 is installed. Prior to the installation of the connector 42 to the cable 10, sheet conductor 16A and 16B is stripped from the insulation 14. Then, the connector 42 is installed in a conventional manner on the insulation 14 and the signal conductors 12 (not shown). In the case of balanced drive it is not necessary to separately terminate the sheet conductor 16A and 16B. In the case of unbalanced drive where the sheet conductor 16A and 16B carries the common signal return, the sheet conductor 16A and 16B must be terminated with a low impedance connection to the signal ground of the equipment.

Thus, it can be seen that there has been shown and described a novel ribbon cable. It is to be understood, however, that various changes, modifications, substitutions in the form and the details of the cable can be made by those skilled in the art without departing from the scope of the invention as defined by the following claims.

What is claimed is:

1. A flexible ribbon cable having a signal portion comprising:

a plurality of substantially longitudinally parallel circular conductors having a uniform diameter and lying in a single plane, said plurality of conductors having transversely uniform predetermined and longitudinally uniform cross-sectional spacing;

insulation encasing said plurality of conductors having a uniform effective dielectric constant of not more than 3.0 and having two outer surfaces substantially parallel to said single plane; and a sheet conductor having a maximum resistivity of not more than 3.5 milliohms per square, said sheet conductor having two inner surfaces conforming to said two outer surfaces of said insulation, said sheet conductor being bonded to said insulation on said two outer surfaces, and said sheet conductor encasing said insulation on substantially all cross-sectional sides and providing both transverse and longitudinal electrical continuity;

where the ratio of the value of the diameter of said parallel circular conductors to the value of the distance between centers of said parallel circular conductors is not less than 0.16 and not more than 0.42; and where the ratio of the value of the distance between said two inner surfaces of said sheet conductor to the value of the distance between centers of said parallel circular conductors is not more than 1.5;

whereby the electrical characteristics of said signal portion of said flexible ribbon cable approximate the electrical characteristics of a coaxial cable with a comparable insulation thickness.

2. A flexible ribbon cable as in claim 1 wherein said insulation has a dielectric loss tangent of not more than 0.005 between 1 megahertz and 1 gigahertz.

3. A flexible ribbon cable as in claim 2 wherein said insulation is a material selected from the group consisting of polyurethane, polyethylene, polypropylene, tetrafluoroethylene, fluorinated ethylene propylene, EPDM rubber and EP rubber.

4. A flexible ribbon cable as in claim 1 wherein said sheet conductor is a cigarette-wrapped around said insulation with an overlap along one of said two outer surfaces of said insulation.

5. A flexible ribbon cable as in claim 1 wherein said insulation has at least one outer surface being ridged longitudinally with said ridges corresponding to said plurality of circular conductors.

6. A flexible ribbon cable as in claim 1 wherein said sheet conductor is strippable from said insulation so that removal of said sheet conductor may be effected where desirable in order to terminate said ribbon cable.

7. A flexible ribbon cable as in claim 6 wherein an adhesive intimately bonds said two inner surfaces of said sheet conductor to said two outer surfaces of said insulation.

8. A flexible ribbon cable as in claim 1 wherein the dimensions of said signal portion are determined by:

$$b \leqq \frac{1.94\,c}{(3.01)^{d/c}}$$

where b is the value of said spacing between said two inner surfaces of said sheet conductor;

where c is the value of said distance between centers of said parallel circular conductors; and where d is the value of said diameter of said parallel circular conductors;

whereby the backward crosstalk for said signal portion is limited to not more than 7.5%.

9. A flexible ribbon cable as in claim 1 wherein the dimensions of said signal portion are determined by:

$$b \leqq \frac{1.60\,c}{(2.82)^{d/c}}$$

where b is the value of said spacing between said two inner surfaces of said sheet conductor;

where c is the value of said distance between centers of said parallel circular conductors; and where d is the value of said diameter of said parallel circular conductors;

whereby the backward crosstalk for said signal portion is limited to not more than 5%.

10. A flexible ribbon cable as in claim 1 wherein said insulation comprises separate layers of dielectric material lying just above and just below said single plane and intimately bonded together and to said plurality of circular conductors.

11. A ribbon cable as in claim 10 wherein said separate layers of dielectric material are bonded with an adhesive comprising a block copolymer elastomer stabilized with antioxidants.

12. A ribbon cable as in claim 11 wherein said adhesive for said separate layers of dielectric material is a block copolymer elastomer stabilized with anti-oxidants.

13. A flexible ribbon cable as in claim 1:

wherein said transversely uniform predetermined and longitudinally uniform cross-sectional spacing is between 45 mils to 65 mils;

where the value of said distance between said two inner surfaces of said sheet conductor is from 35 to not more than 75 mils; and where the cross-sectional area of said parallel circular conductors is from 32 AWG to not more than 26 AWG.

* * * * *